United States Patent [19]

Nocek

[11] Patent Number: 4,744,674

[45] Date of Patent: May 17, 1988

[54] NON-RECLOSABLE MECHANICALLY FILLABLE AND CLOSABLE LINK BAG STRUCTURE AND METHOD

[75] Inventor: Robert Nocek, Stamford, Conn.

[73] Assignee: Minigrip, Inc., Orangeburg, N.Y.

[21] Appl. No.: 1,045

[22] Filed: Jan. 7, 1987

[51] Int. Cl.[4] ..... B65D 33/16

[52] U.S. Cl. ..... 383/63; 383/61; 206/608; 206/610

[58] Field of Search ..... 383/63, 61, 94, 41; 206/601, 604, 606, 608, 609, 610, 611, 614, 634

[56] References Cited

U.S. PATENT DOCUMENTS

| | | | |
|---|---|---|---|
| 2,643,049 | 6/1953 | Bartalt | 206/608 |
| 3,534,901 | 10/1970 | Repko et al. | 383/94 |
| 4,116,338 | 9/1978 | Weichselbaum | 206/610 |
| 4,630,311 | 12/1986 | Bentson | 383/63 |

FOREIGN PATENT DOCUMENTS

| | | | |
|---|---|---|---|
| 1435827 | 8/1964 | Fed. Rep. of Germany | 383/63 |
| 0551216 | 11/1956 | Italy | 383/63 |

*Primary Examiner*—Willis Little

*Attorney, Agent, or Firm*—Hill, Van Santen, Steadman & Simpson

[57] ABSTRACT

A container structure including a bag body formed of flexible plastic film with a top through which the contents may be filled or emptied from the bag interior and a mechanically interconnectable rib and groove fastener along the top which is unopenable manually externally such as by having an absence of flaps or projections at the top. In one form the top of the bag has to be torn off along predisposed paths to remove the interlocked rib and groove element, and in another form, the walls have to be cut at an appropriate location so that they may be pulled apart.

27 Claims, 1 Drawing Sheet

26
27
13
10
12
11

18
19
16
17
26
27
11
13
14
12
15

22
20a
20
21
18
23
25
24
26
27
29
19
21a
13
10
11
12

26
27
13
29
28
12
11

30

31
11
12

NON-RECLOSABLE MECHANICALLY FILLABLE AND CLOSABLE LINK BAG STRUCTURE AND METHOD

BACKGROUND OF THE INVENTION

This invention relates to improvements in flexible plastic film bags and more particularly to improved fasteners therefor which protect the contents and feature unique features for protecting the contents and eventually opening the bag.

In the development of closures for flexible film plastic bags, an important basic discovery has involved a mechanically closable rib and groove element. These rib and groove elements may take various shapes and with the various shapes, different physical advantages and features are achieved. One of the important advantages of a rib and groove type of closure is that it provides a convenient way of sealing a bag in that most rib and grooves when joined provide a moisture and air tight seal. A further feature is that a rib and groove arrangement can be relatively easily closed so that the bag can be filled and closed merely by applying mechanical closing pressure to force the rib element into the groove element. In the generic reference to rib and groove closure elements, it is recognized that there are many shapes and forms and the ribs and grooves are provided in single or multiple numbers and the present invention is not limited to one particular design but incorporates various designs having the physical characteristics which will be described herein.

For plastic bags handling various commodities including foodstuffs, it is advantageous to provide tamper-proof or tamper-evident features. That is, it is desirable to have a fastener which can contain material such as foodstuffs whereby the customer cannot open the bag or if opened, that it will be evident from viewing the bag that it has been opened and tampered with.

It is recognized that the art heretofore has included structures employing rib and grooves which when interlocked, they cannot be separated by pulling apart on the webs, as is disclosed for example in U.S. Pat. No. 3,808,649 issued to Steven Ausnit on May 7, 1974.

It is accordingly an object of the invention to provide a new and unique top fastener for a flexible plastic film bag employing an interlocking rib and groove but being manually unopenable by the usual manual external separation of the rib and groove.

A further object of the invention is to provide an easy open improved top fastener for a flexible plastic film bag which has tamper-evident features so that a previous unauthorized partial opening of the bag is evident by a visual inspection.

In accordance with the principles of the invention, a feature is to provide a rib and groove closure for the top of a flexible plastic film bag which has the advantage of readily being closed after filling and where the rib and groove would normally be separable manually except that the structure is provided so that no manual way is available to apply a lateral separating force transverse of the rib and groove fastener, and there are either no separation flaps extending above the rib and groove or only one so that the rib and grooves cannot be pulled apart.

A further feature of the invention is to provide a rib and groove fastener for the top of a flexible plastic film bag to afford the advantage of normal closing but wherein the rib and groove cannot be manually separated once closed and where the bag has to be opened by tearing a strip from the top of the bag.

A further feature of the invention is to provide a closable rib and groove element to close the top of a plastic film bag wherein the walls of the bag are perforated or spot joined beneath the fastener and are separable with a force less than that required to separate the rib and groove elements by a twisting or by longitudinally moving one profile against the other in opposing directions.

In summary, a feature of the invention is to provide a bag which, after it has been loaded, and the profiles closed and upper flanges either removed or omitted, the bag cannot be opened through the use of normal opening forces. There are no flanges or lips to provide such normal opening forces. Also, to provide a bag wherein if the fastener is subjected to other abnormal forces, such as twisting or driving one part of the fastener against the other in opposing directions, such forces will cause a tear line below the fastener to yield before the fastener will open. The fastener is not openable from above the profile and is not openable from below the profile.

Other advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figures 1, 2, 3, 4, 5, 6:
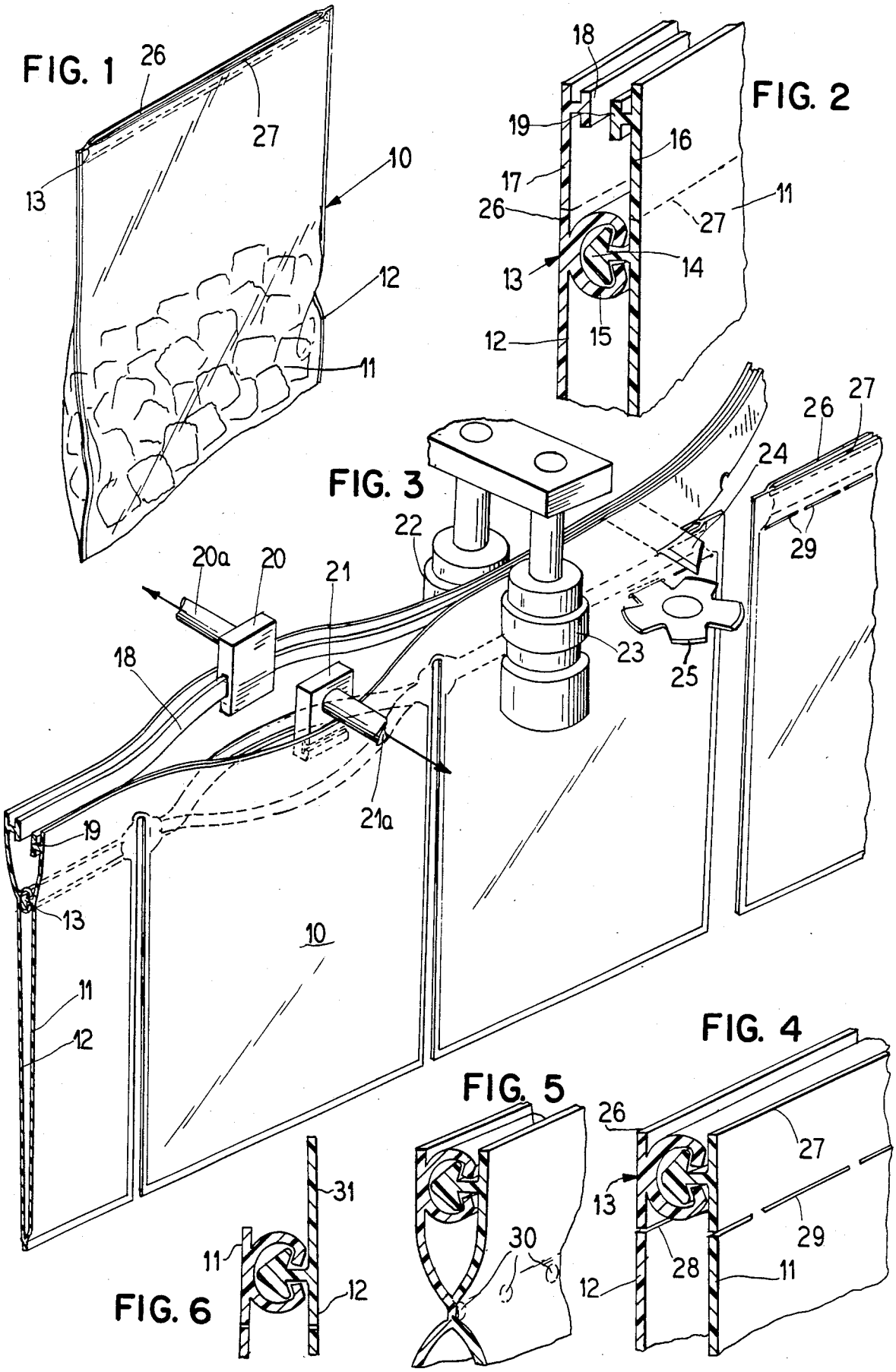
FIG. 1 is a perspective view of a bag having a closure constructed in accordance with the principles of the present invention after removal of strips at the top of the bag.
FIG. 2 is a vertical section taken through the closure of a bag prior to removal of material from the bag top.
FIG. 3 is a perspective view somewhat diagrammatic in form illustrating filling and closing bags constructed in accordance with the invention.
FIG. 4 is a perspective view with a vertical section taken through the closure of the top of a bag containing features of the invention.
FIG. 5 is a view similar to FIG. 4 illustrating another form of the bag.
FIG. 6 is a view similar to FIG. 4 illustrating another form of the bag.

FIG. 1 illustrates a completed flexible film bag 10 closed at the top having been filled with contents. The flexible film bag has a front wall 11 and a rear wall 12 with seams along the edges to complete the bag or container. At the top is a fastener 13 which forms a permanent closure for the bag, sealing the contents from moisture and foreign elements. A feature of the invention is that the closure 13 employs rib and groove elements. The rib and groove elements may be of the form that are attached to the inner surfaces of the bag or they may be of the form that are integral with the bag walls utilizing an advantage of such closure elements in that they can be extruded with the film in a single operation and thereby made inexpensively.

FIG. 2 illustrates one form of the top of the bag prior to completion with the closure shown at 13 as including a rib element 14 inserted interlocked into a groove element 15. At this point, the bag has flaps 16 and 17 extending above the rib and groove element and the flaps have inwardly extending ribs 18 and 19 at the top for convenience in handling the bags and holding them open during a filling operation as will be observed from FIG. 3.

In FIG. 3 the bags which are interconnected to form a chain are drawn along a machine. Separator shoes 20 and 21 with grooves to receive the ribs 18 and 19, move reciprocally as indicated by the arrowed lines 20*a* and 21*a* to separate the top walls of the bag and hold it open for filling. Filling may be done automatically by a filling tube or done manually. The chain of bags is pulled to the right, as shown in FIG. 3, such as by closing rollers 22 and 23. These rollers are shaped and have a position so that they apply a closing force to the rib and groove elements 14 and 15 to join them after the bags have been filled.

In some instances the rib and groove elements may be designed so that they can be closed only by a special tool which pulls the groove element apart to allow entry of the rib element and once the rib element has been interlocked in the groove, it cannot be separated therefrom by pulling apart on the webs in a manner disclosed in the aforementioned U.S. Pat. No. 3,808,649. If a special tool is used, it must be such that it literally would have to come in and out of the female profile in each instance.

A line of perforations 29 is formed in the bag walls below the rib and groove elements. These may be existent in the bag material before it is filled and closed or may be placed in the bag material in the operation shown in FIG. 3 such as by having a perforating wheel 25 place the perforations 29 in the material across the top of the bag.

Following the rollers 22 and 23, a knife 24 is arranged to cut the top extension flaps from the bag along the lines indicated at 26 and 27 in FIG. 2. A perforating wheel 25 creates a series of perforations beneath the zipper 13, if activated, providing the film of bag 10 was not supplied with perforations in place. The location of these cuts is important in that the finished bag will have no opening flaps extending above the zipper 13. With an absence of such flaps, the zipper cannot be grasped manually to pull the rib and groove 14 and 15 apart. Thus, two forms of structure are contemplated both of which result in the rib and groove elements being manually unseparable. In one form the rib and groove are free of means for applying normal separating forces and in another form, they are constructed so that the rib and groove cannot be separated by applying separating forces. FIGS. 4, 5 and 6 each show interlocked rib and groove elements which are free of means for applying separating forces. In FIGS. 4 and 5, the top edges 26 and 27 of the bags terminate right at the location of the rib and groove elements so that they cannot be gripped for separating. In FIG. 6 only one flap 31 is provided extending above only one of the rib and groove elements. This may provide a means for carrying the bag but since the other of the elements cannot be gripped, there is no way that a lateral force can be applied from externally of the bag to separate the rib and groove elements.

Inasmuch as the rib and groove elements are manually unseparable from externally of the bag, in the bag construction of FIG. 4, the only way that the bag can be opened is by tearing off a top strip along the bag which removes the interlocked rib and groove elements. Such tearing, of course, is intended to be done only by the eventual purchaser and user, and if the bag is opened or if it is even partially torn, this will be immediately visible so that the bag is tamper-evident. For tearing off the top strip, means are provided accommodating the removal of the strip and in the form shown in FIG. 4, these are provided by perforation lines 28 and 29. In one form these lines may be provided by indentations or lines of weakened resistance in each wall of the bag so as to not allow the entrance of air through perforations.

In another form of the bag as illustrated in FIG. 5, means are provided beneath the interlocked profiles holding the bag walls together. This may be provided by heat sealed spaced dots, or by a peelable adhesive connection. In such construction, the bag walls may be separated to break the spaced dots or to separate the adhesive bond and thus the bag walls can be separated by first tearing off the top strip containing the rib and groove closure and then pulling them apart. If the bag has been tampered with by breaking the spaced dots or the perforations have been torn in an attempt to get at the bag contents, this will immediately be visible.

In each of the foregoing arrangements, the finished bag will have the appearance shown in FIG. 1 wherein the interlocked rib and groove is at the very top edge of the bag and no flaps extend above the top edge. The bag may have a tear-line accommodating tearing the top fastener strip therefrom, or in another form may require cutting a section of the bag to get at the contents.

In operation with the arrangement of FIG. 4, the completed bag has been filled and sealed by joining the rib and groove. The rib and groove provide an economical direct way of completely sealing a bag. A tamper-proof feature is provided that the rib and groove cannot be separated externally thereby forcing a user to tear off the top strip along the lines 28 and 29 to open the bag.

Thus, it will be seen that I have provided an improved bag and fastener therefor which meets the objectives and advantages above set forth and provides an effective efficient means of closing a bag and a tamper-evident protection, while providing an easy opening feature as well.

I claim as my invention:

1. A container structure comprising in combination:

a bag body formed of a flexible plastic film having a top through which contents may be filled or emptied from the bag interior;

a mechanically interlockable rib and groove continuous fastener along said top located at the edge of the film with an absence of projections of any substantial grippable length extending above said fastener so that a lateral separating force connot be applied externally of the bag for opening;

and means below said fastener for normally cooperating with said fastener for maintaining the bag closed;

said means being forcibly separable to permit opening of the bag.

2. A container structure constructed in accordance with claim 1:

wherein said means comprises frangible means for joining the bag walls below said fastener.

3. A container structure constructed in accordance with claim 1:

wherein said means permits tearing the top from the bag and thereby removing the fastener from the bag separating the material of the bag walls for access to the interior.

4. A container structure constructed in accordance with claim 3:

wherein said means is in the form of perforations extending across the bag substantially parallel to the top.

5. A container structure constructed in accordance with claim 1:

wherein said means comprising said bag walls connected by spot seals extending across the bag.

6. A container structure constructed in accordance with claim 1:

wherein said means comprising the bag walls joined by a peelable adhesive seal.

7. A container structure constructed in accordance with claim 1:

wherein said rib and groove are mechanically joined to each other to provide a permanent seal for the top of the bag.

8. A container structure comprising in combination:

a bag body formed of a flexible plastic film having a top through which contents may be filled or emptied from the bag interior;

a mechanically interlockable rib and groove continuous fastener along said top located initially along upwardly projecting top extension flap structure at the top edge of the film;

said bag top and rib and groove element being free of means for applying opposite separating forces to the rib and groove by virtue of said top extension flap structure having been trimmed off;

and means below said said fastener for normally cooperating with said fastener for maintaining the bag closed;

said menas being forcibly separable to permit opening of the bag.

9. A container structure constructed in accordance with claim 8:

including a flap extending above one of said rib and groove members with an absence of means extending above the other of said members.

10. A container structure comprising in combination:

a bag body formed of a flexible plastic film having a top through which contents may be filled or emptied from the bag interior;

a closure including opposed mechanically connectable continuously extending interlockable rib and groove elements along the top of the bag, said rib and groove elements when interlocked being separable only by means of other abnormal separating forces;

and a secondary closure including frangible means located below said closure which means will rupture before said abnormal forces can separate said closure thereby exposing contents of the bag.

11. A container structure constructed in accordance with claim 10:

wherein said frangible means includes a plurality of sequential spot seals joining the walls of the bag and being frangible with the application of said abnormal forces.

12. A container structure constructed in accordance with claim 10:

wherein said secondary closure includes a continuous frangible junction between the walls separable with the application of said abnormal forces.

13. A container structure constructed in accordance with claim 10:

wherein said frangible means includes a surface-to-surface peelable connection joining said walls within the bag and separable with the application of said abnormal forces.

14. A container structure comprising in combination:

a bag body formed of a flexible plastic film having a top through which contents may be filled or emptied from the bag interior;

a mechanically interconnectable rib and groove continous fastener along the top of the bag with said rib and groove being manually unseparable when interlocked;

and means accommodating manual removal of a strip from the top of the bag and said rib and groove fastener so that said bag is permanently closed by the rib and groove when filled and openable solely by removal of said strip from the top of the bag.

15. A container structure constructed in accordance with claim 14:

wherein said means accommodating manual removal is in the form of a lateral weakened area of the film so that a strip may be torn from the film.

16. A container structure constructed in accordance with claim 14:

wherein said means accommodating manual removal is in the form of perforations through the material of the bag walls extending across the top of the bag.

17. A container structure comprising in combination:

a bag body formed of a flexible plastic film having a top through which contents may be filled or emptied from the bag interior;

mechanically interconnectable rib and groove elements along the top of the bag, said rib and groove elements when interlocked being unopenable by separation of the bag walls beneath the closure of a predetermined force;

and a frangible means in the bag wall being frangible at a force less than said predetermined forces so that forces applied to the bag wall will fracture said frangible means preventing separation of the rib and groove elements.

18. A container structure constructed in accordance with claim 17:

wherein said frangible means is in the form of means weakening the normal strength of the material of the bag wall.

19. A container structure constructed in accordance with claim 17:

wherein said frangible means is in the form of perforations in the material of the bag walls.

20. A method in a making a container structure comprising a bag body formed of a flexible plastic film having a top through which contents may be filled or emptied from the bag interior, comprising:

providing a mechanically interlockable rib and groove continuous fastener along said top located initially along upwardly projecting top extension flap structure at the top edge of the film;

providing means below said fastener for normally cooperating with said fastener for maintaining the bag closed;

trimming off said extension flap structure so that said bag top and rib and groove elements are free of means for applying opposed separating force to the rib and groove element;

and constructing said means to be forcibly separable to permit opening of the bag.

21. A method according to claim 20, which comprises leaving a flap of said extension flap structure extending above one of said rib and groove members while trimming off the flap extension structure above the other of said members.

22. A method according to claim 20, which comprises providing said means as frangible means joining walls of the bag below said fastener.

23. A method according to claim 20, which comprises providing said means as a tearable structure so that the top of the bag can be torn therefrom and thereby removing the fastener from the bag and separating the material of walls of the bag for access to the bag interior.

24. A method according to claim 23, which comprises forming said means as perforations extending across the bag substantially parallel to said top.

25. A method according to claim 20, which comprises providing said means by connecting said bag body film by spot seals extending across the bag.

26. A method according to claim 20, which comprises providing said means by joining walls of the bag by a pealable adhesive seal.

27. A method according to claim 20, which comprises providing said rib and groove mechanically joined to each other to provide a permanent seal for the top of the bag.

* * * * *